US007669526B2

(12) United States Patent
Fay

(10) Patent No.: US 7,669,526 B2
(45) Date of Patent: Mar. 2, 2010

(54) APPARATUS FOR TENSIONING A BAND

(75) Inventor: Adolf Fay, Riedlingen (DE)

(73) Assignee: Greiner GmbH & Co. KG, Esslingen (DE)

( * ) Notice: Subject to any disclaimer, the term of this patent is extended or adjusted under 35 U.S.C. 154(b) by 0 days.

(21) Appl. No.: 12/224,714

(22) PCT Filed: Feb. 27, 2007

(86) PCT No.: PCT/EP2007/001663

§ 371 (c)(1),
(2), (4) Date: Sep. 11, 2008

(87) PCT Pub. No.: WO2007/101583

PCT Pub. Date: Sep. 13, 2007

(65) Prior Publication Data

US 2009/0071350 A1 Mar. 19, 2009

(30) Foreign Application Priority Data

Mar. 9, 2006 (DE) ..... 10 2006 010 912

(51) Int. Cl.
*B65B 13/22* (2006.01)
*B65B 13/16* (2006.01)

(52) U.S. Cl. ..... 100/32; 100/6; 242/419.9; 242/586.4

(58) Field of Classification Search ..... 100/6, 100/29, 32, 33 R, 33 PB; 53/590, 591, 592; 140/93.2, 93 A; 156/579; 242/419.8, 419.9, 242/532.5, 586.4, 586.5
See application file for complete search history.

(56) References Cited

U.S. PATENT DOCUMENTS

| | | | | |
|---|---|---|---|---|
| 4,243,077 | A * | 1/1981 | Sansum | 140/93.4 |
| 4,605,456 | A * | 8/1986 | Annis, Jr. | 156/157 |
| 6,131,634 | A | 10/2000 | Chang | |
| 6,708,606 | B1 * | 3/2004 | Bell et al. | 100/32 |
| 6,962,108 | B1 * | 11/2005 | Yu Chen | 100/6 |

FOREIGN PATENT DOCUMENTS

DE 100 26 200 A1 11/2001

* cited by examiner

*Primary Examiner*—Jimmy T Nguyen
(74) *Attorney, Agent, or Firm*—Roylance, Abrams, Berdo & Goodman, L.L.P.

(57) ABSTRACT

An apparatus for tensioning a band, in particular a strapping device, includes a drive unit (10) which, in the operated state, drives a band winding unit (12) selectively in opposite directions of rotation. As a result of the band (18), which can be inserted into the apparatus, being releasably locked in predefinable positions by an operating device (14) actuated by a control device (16) of the band winding unit (12), functional positioning of the band winding unit is started to fix the band. The band can be inserted into the apparatus, in the tensioned or tautened state to then be able to insert the band tensioning apparatus for a new strapping operation after the band is severed.

20 Claims, 9 Drawing Sheets

APPARATUS FOR TENSIONING A BAND

FIELD OF THE INVENTION

The present invention relates to an apparatus for tensioning a band, in particular a strapping device. The apparatus has a drive unit which, in the actuated state, drives a band winding unit selectively in one of opposite directions of rotation.

BACKGROUND OF THE INVENTION

Band tensioning apparatus and strapping devices are readily available on the market in a plurality of embodiments. The known solutions, however, have been found to be difficult to manage in manual use, whether due to their dimensions or due to their weight in use. The known solutions are also to some extent costly to produce and are fault-susceptible in operation due to their construction.

SUMMARY OF THE INVENTION

An object of the present invention is to develop an apparatus for tensioning a band allowing economical production, being reliable and being easily handled in use with reduced geometrical dimensions.

This object is basically achieved by an apparatus with an actuating device which can be triggered by the control device of the band winding unit. The band insertable into the apparatus is releasably locked in definable positions. The operating position of the band winding unit is used to fix the band which can be inserted into the device in the tensioned or tightened state. Then, the band tensioning apparatus can be used for a repeated strapping process after the band is cut. Due to this mechanical positive coupling, the winding and locking processes, in addition to loosening the band for a re-attachment process, proceed entirely automatically. This operation greatly simplifies handling in terms of actuating processes. This mechanical trigger device can also be housed in a space-saving manner within the apparatus so that the solution according to the present invention is geometrically small and need have only a small weight in use. Moreover, the apparatus with its mechanical trigger components can be economically implemented or produced. As a result of the triggering processes of diverse control parts of the apparatus which proceed largely automatically, a reliable tensioning or strapping process is ensured.

In one especially preferred embodiment of the apparatus according to the present invention, a rotatable cutting means for the band is integrated in the housing of the apparatus, and can be guided in a slot guide provided with at least one cutting blade in the rotary position allowing the band to be cut. In this way, within the device another function is implemented, specifically that of cutting, in addition to the functions of winding and locking of the band. Preferably, to drive the rotatable cutting means, a rod drive is used which can be actuated by parts of a lever mechanism which causes the winding processes and the attachment and release of the band inserted into the apparatus. As a result of the mechanical positive coupling by the rod drive, in this respect a reliable sequence is ensured since triggering of a function at the same time triggers the following function in a defined manner.

In another especially preferred embodiment, the drive unit is a pneumatic motor having two opposite directions of rotation, and interacting with the band winding unit by a worm drive. Since commercial buildings generally have pneumatic supply means, the pneumatic motor can be connected to a compressed air supply almost anywhere allowing extensive independence when using the tensioning apparatus on site. With a pneumatic motor high forces can be applied and still a limit can be defined depending on the maximum definable working pressure. Even in the case of improper operation, the drive motor cannot then damage the mechanical components of the apparatus. This pressure limitation overall also benefits the safety of the apparatus in use. Otherwise the use of pneumatic drives has little susceptibility to dirt so that the apparatus according to the present invention can also be used in challenging areas such as the food industry, the pharmaceutical industry, electronics industry, etc. Fundamentally, the use of other drive concepts is also possible.

The apparatus according to the present invention for tensioning of a band can be used for almost any band size and for any packaging purpose in which a band for the purpose of strapping is placed around the packaged article and then tightened, for example, to bundle several packaging units of the packaged article to one another.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure and which are schematic and not to scale.

DETAILED DESCRIPTION OF THE INVENTION

Figure 1:
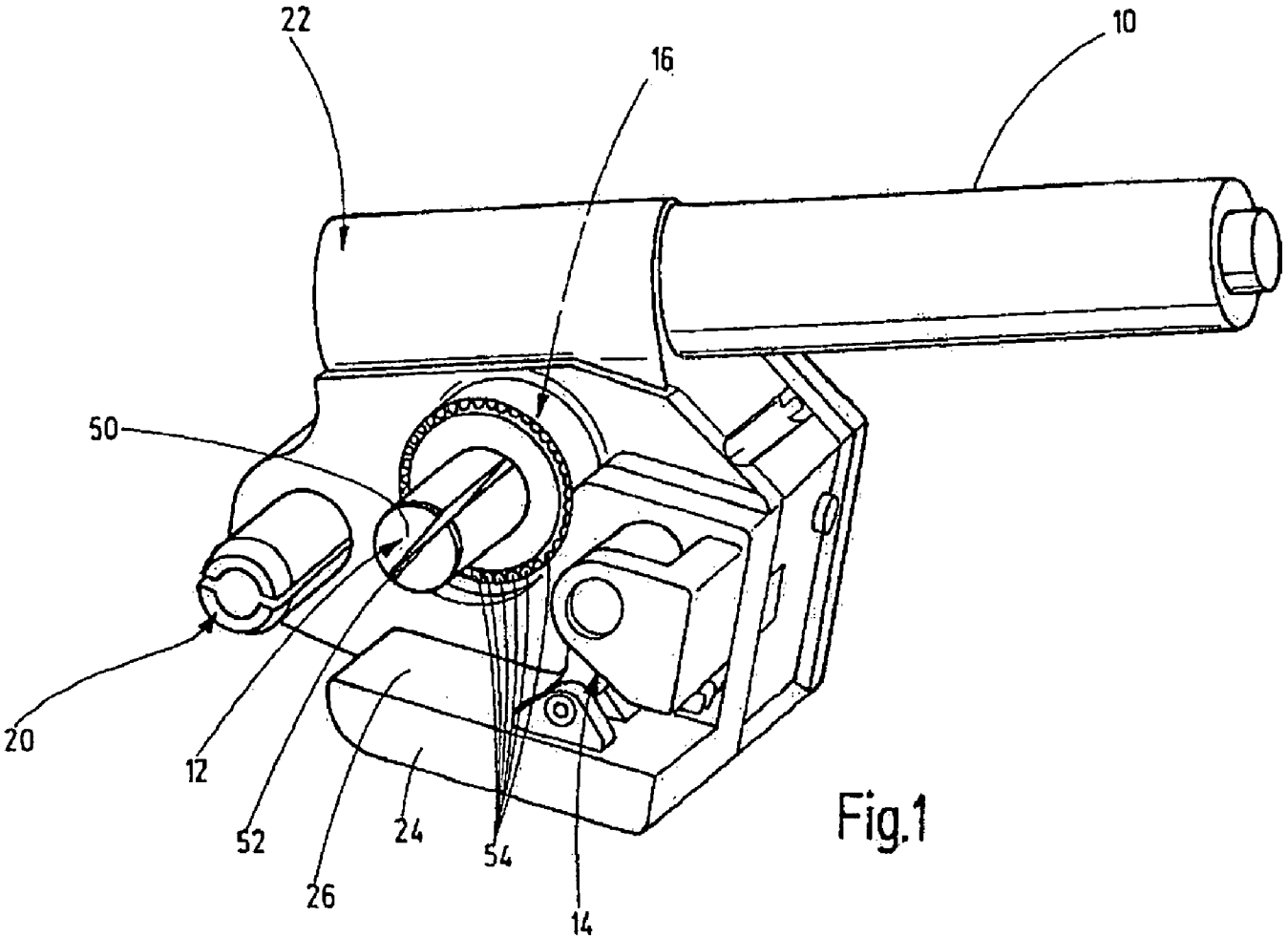
FIG. 1 is a perspective view of a band tensioning apparatus with a winding and cutting means according to a first exemplary embodiment according to the present invention.

FIG. 1 shows a perspective side view of a band tensioning apparatus used as a strapping apparatus, but without the band to be tensioned. The tensioning apparatus shown in FIG. 1 has a drive unit 10 which in the actuated state drives a band winding unit 12 selectively and alternatively in opposite directions of rotation. By an actuating device or actuator 14 triggered by a control device or control 16 of the band winding unit 14, which will be detailed below, a band or strapping band 18 inserted into the apparatus, not shown in FIG. 1, can be releasably locked in definable positions. To cut the band, a cutting means or cutter 20 (FIG. 4) is used. All these components of the tensioning apparatus are integrated in a tensioning housing 22 of the apparatus. This tensioning housing 22, as viewed in FIG. 1 on its underside, has a plate-like support shoe 24. The underside of support shoe 24 makes it possible to support the apparatus on a packaged article. On its opposite exposed top, a guide surface 26 guides the band to be tensioned.

Figure 2:
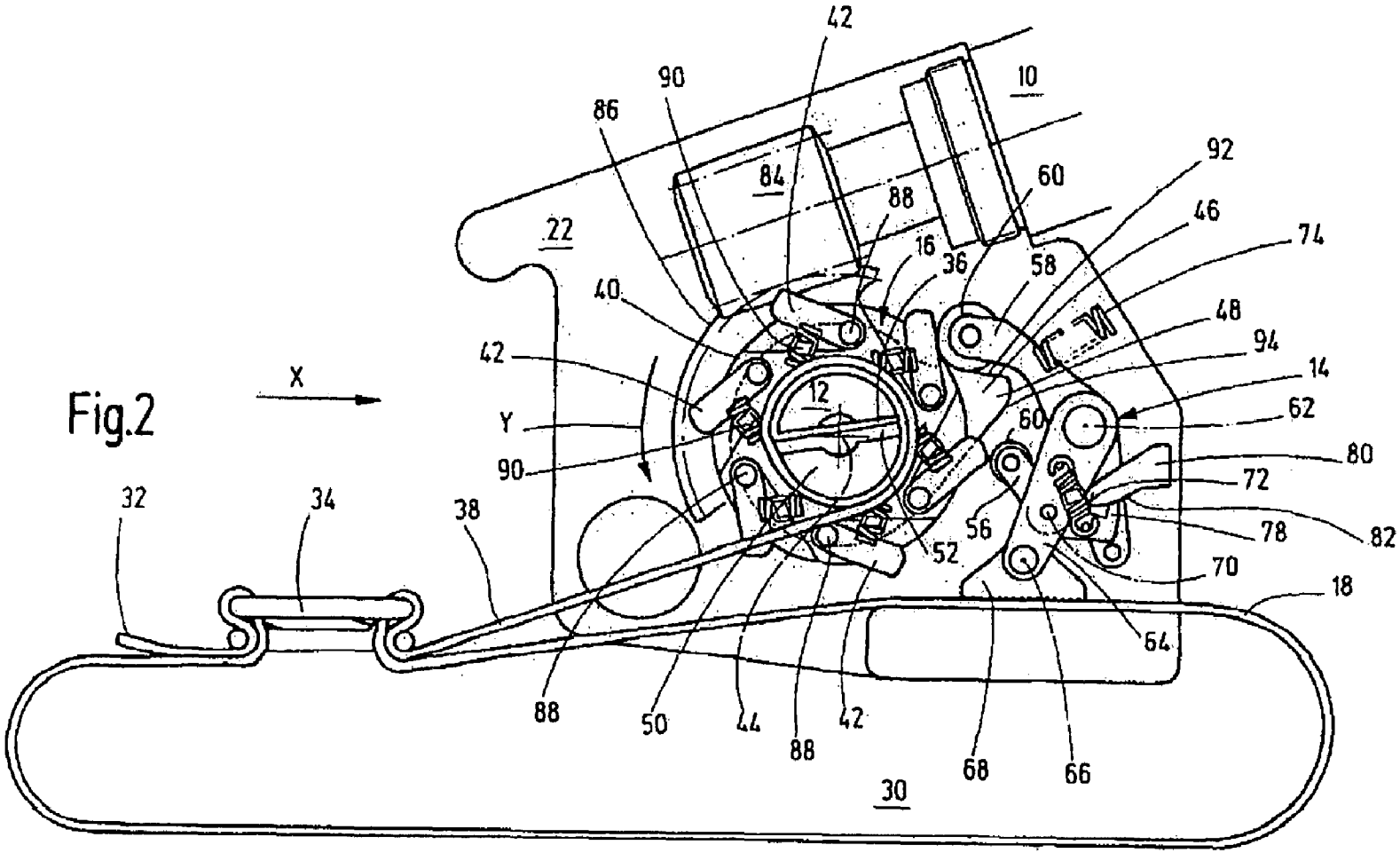
FIG. 2 is a side elevational view of one part of the apparatus shown in FIG. 1, without the cutting means.

FIG. 2 shows a face or side view of the tensioning apparatus of FIG. 1 with the tensioning housing 22 partially cut away for better representation of the interior operation of the apparatus. In FIG. 2, the cutting means 20 is omitted since in the basic embodiment the illustrated apparatus can also be used as a pure band tensioning apparatus with cutting of the band taking place outside the device, for example, with a separate cutting means in the form of a knife (not shown). The band 18 is shown schematically in FIG. 2. The band 18 can be a steel band, a plastic band or one with steel or plastic reinforcing. In the closed state shown in FIG. 1, the band straps a packaged article (not shown) held in the winding loop 30. In particular, glued bands or those woven from plastic fibers are used.

Since the band 18 is generally used for a standard strapping process of a defined packaged article, the length of the band is fundamentally given in defined stages of size. For each type of packaged article, a defined band length is then available. The packaged article can also have several parts so that several packaging units can be held together in a bundle and therefore in a lot size by the band 18. The tensioned and strapped band 18 is used to stiffen the packaged article. In particular when using cardboard as the packaging jacket, the packaging is additionally secured by the band. These relationships are recognized so that they will not be detailed here. Before their processing, the bands can have an exactly defined length matched to the packaged article. With the apparatus according to the present invention, use of any band length is also possible.

For better understanding, the band 18 with its one free or first end 32 is looped around an eye or thimble 34 in a self-locking manner. The other free end 36 of the band is held within the band winding unit 12 after a certain number of turns or loops. Since the number of loops is limited, the length of the band should always be chosen such that not too many turns arise on the band winding unit 12 which can then no longer be handled by the device. The band length, however, should not be too short since otherwise tightening of the band 18 and its attachment on the band winding unit 12 can be at risk. In a system state shown in FIG. 2, the band 18 is clamped within the tensioning apparatus. By winding the band 18 on the band winding unit 12, the eye or the thimble 34 together with the free band end 32 is tightened in the direction of the arrow X to the tensioning housing 22. This tightening shortens the free length of the tensioning band 18 with the result that the band 18 can be placed tightly around the packaged article (not shown).

When this tensioning and winding process is completed, the band 18 can be severed, for example, at the cutting site 38 by a separate cutting means or blade means. The strapping process would then be completed. Instead of the band 18 being a flat body, the band could also be a wire-shaped body. A multiple superimposed arrangement of bands 18 (not shown) could be attached to a third article, such as a packaged article, strapping it. If the band 18 has been cut off at the cutting site 38, by the self-locking of the parts of the eye or cramp for the eye 34, the band 18 in its tensioned position is held by locking.

The control device or control 16 shown in FIG. 2 has a first control part 40 with first control cams 42. These control cams 42 extend in pairs diametrically opposite one another around the longitudinal axis 44 of the band winding unit 12. A second control part 46 with a second control cam 48 of another type is provided. This control cam 48 is present only once, and extends with its outside diameter along a graduated circle larger in diameter than the pivoting circle of the control cams 42 in their maximum possible pivoted-out position. Both control parts 40, 46 can be entrained at least in one direction by the winding shaft 50 of the band winding unit 12. The graduated circle of second control cam 48 need not necessarily be larger. The winding shaft 50 is made as a cylindrical driving pin, and in the center has a continuous longitudinal slot 52 used to entrain the end region of the other or second end 36 of the band. Instead of one longitudinal slot, several longitudinal slots can be provided. If five control cams 42 are used, a diametrically opposite arrangement is replaced by one in which the distances of the control cams 42 in the radial peripheral direction to one another are the same. In each instance, the control cams 42 are preferably located on the same graduated circle.

One of the two control parts, here the control part 40, is provided with a freewheeling means, freewheel device or automatic clutch 54 such that in one of the two possible directions of rotation, as viewed in FIG. 2, the second control part 46 can be entrained or rotated clockwise by the winding shaft 50 without the transfer of force or retains the position it has assumed. In this respect, the control cams 42 of the control part 40 maintain their illustrated position, and together with the second control part 46 turn counterclockwise. In the other direction identified with the arrow Y in FIG. 2 and accordingly counterclockwise, the control parts 40, 46 tend to move in the other direction. The second control part 46 with its control cam 48 then forms an abutment for parts of the actuating device 14. The freewheeling means 54 shown in FIG. 1 is implemented by individual freewheeling bodies held in the inner and outer ring parts of the tensioning housing 22 and the band winding unit 12. These freewheeling means are within the prior art so that they will not be described in detail.

As follows from FIG. 2, the actuating device 14 comprises a multipart lever drive, including a first lever 56 made as an angle lever being triggerable by a first control part 40 with its control cam 42. Another or second lever 58 also made in the form of an angle lever can be triggered by the second control part 46 with its control cam 48. Both levers 56, 58 for their actuation on their free end have a curve roller 60 so that they can slide better on the paths formed by the control cams 42, 48. The other lever 58 on its other free end is pivoted in the tension housing 42 via an axis 62 of rotation. Another or third actuating lever 64 is rigidly coupled to the lever 58, and via another articulation 66 bears a foot-shaped locking means or lock 68 for clamping or tightening the band 18. The underside of the locking means 68, as shown in FIG. 2, is provided with fluting to increase the force of engagement with the band surface 18.

Figure 9:
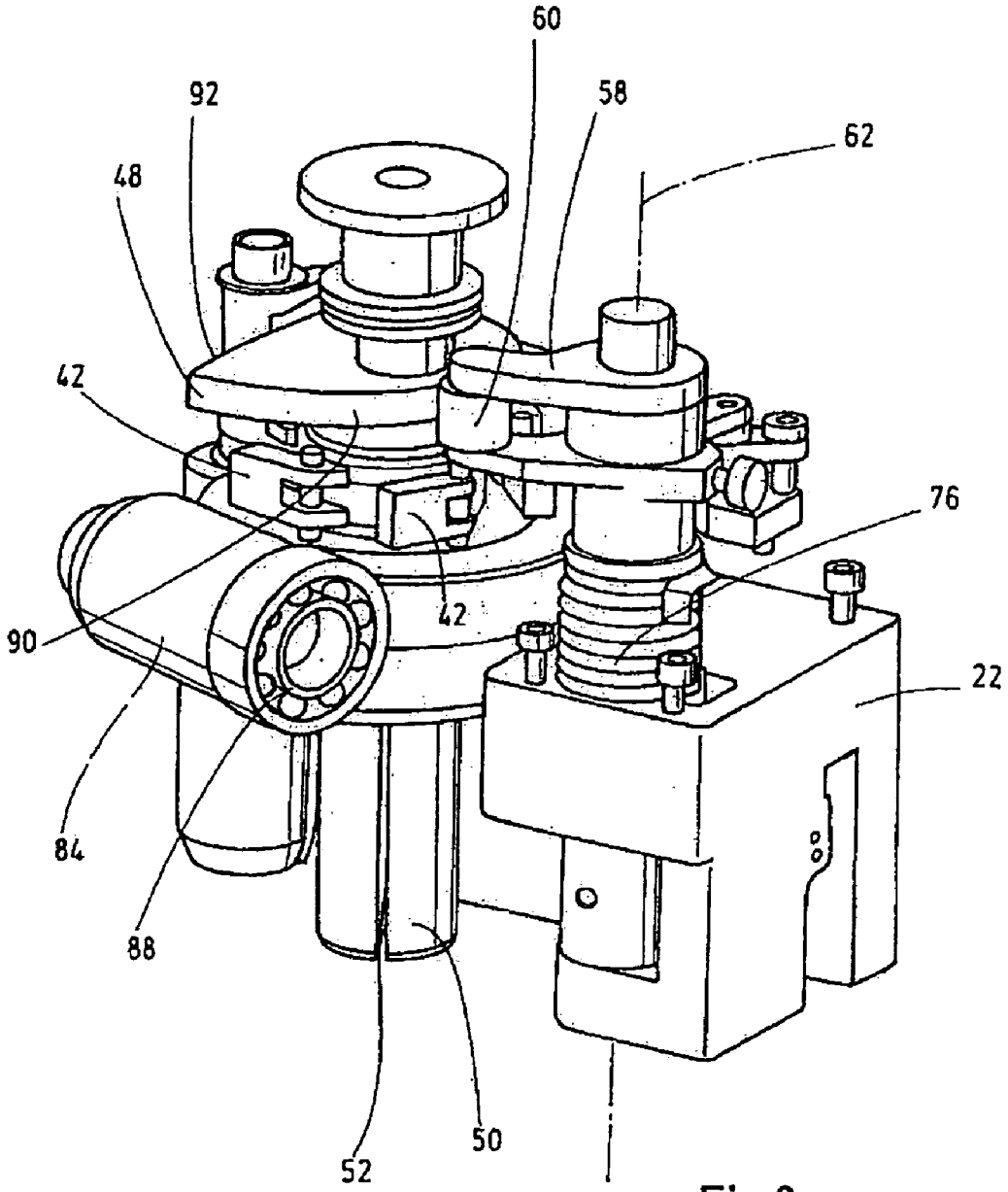
FIG. 9 is a perspective view of part of the tensioning apparatus of FIG. 1, with the housing partially cut away.
Figure 10:
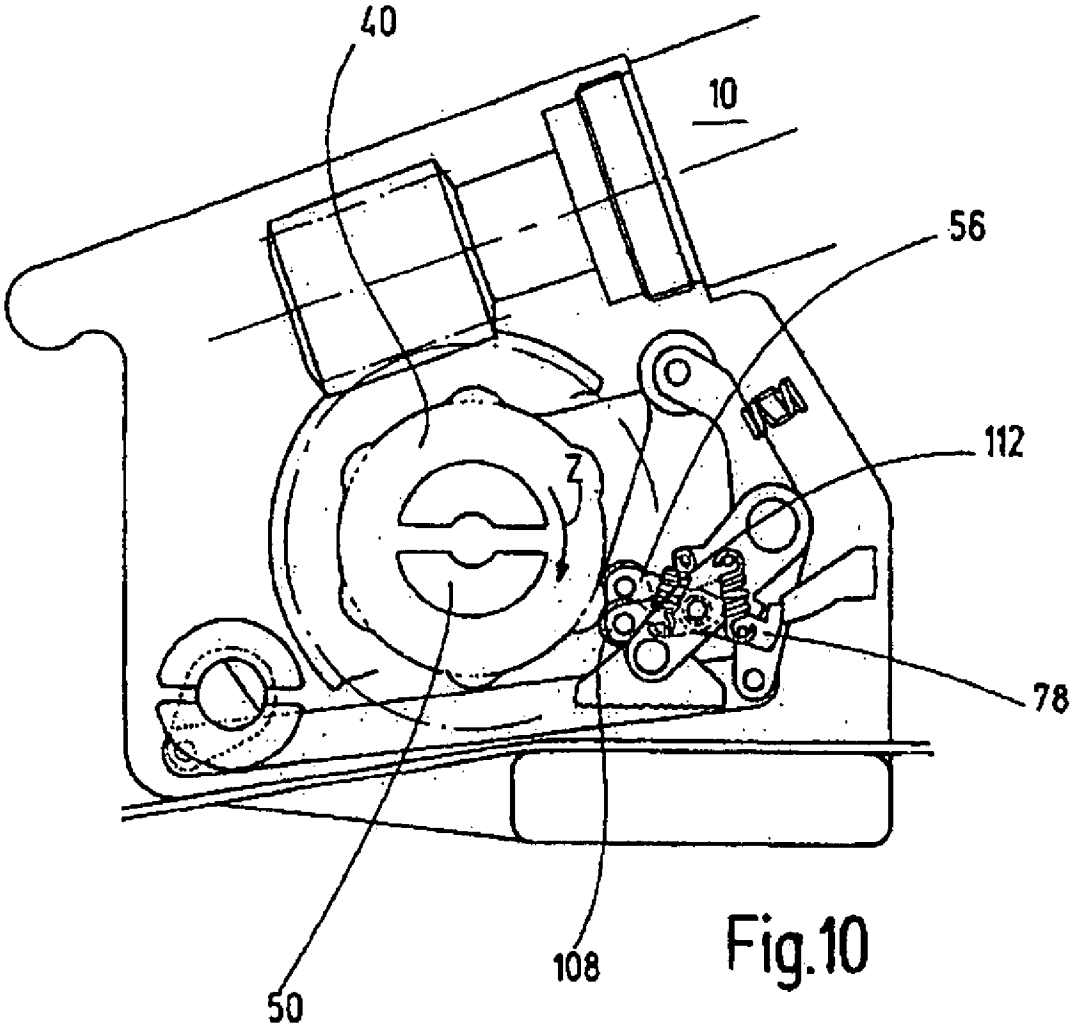
FIGS. 10 to 13 are side elevational views of a tensioning apparatus according to a second exemplary embodiment of the present invention.
Figure 13:
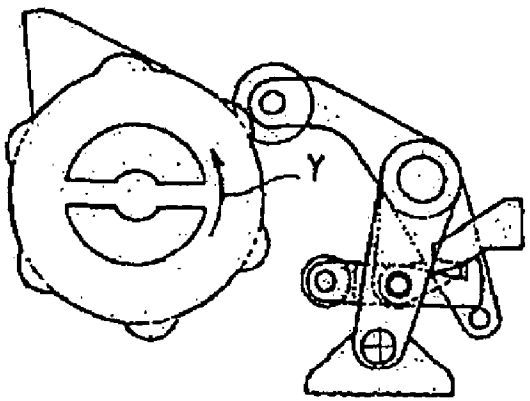
Figure 12:
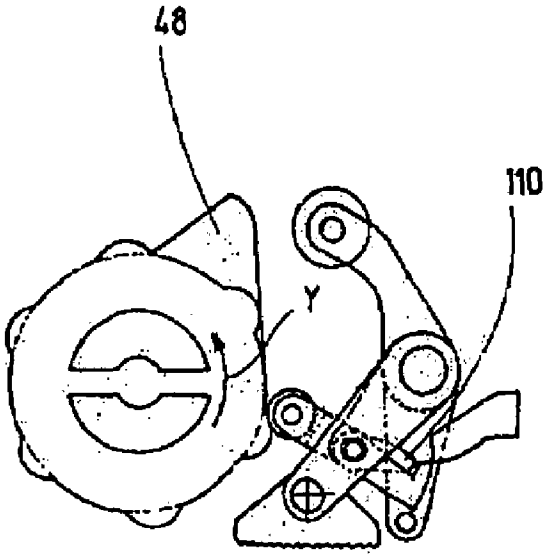
Figure 11:
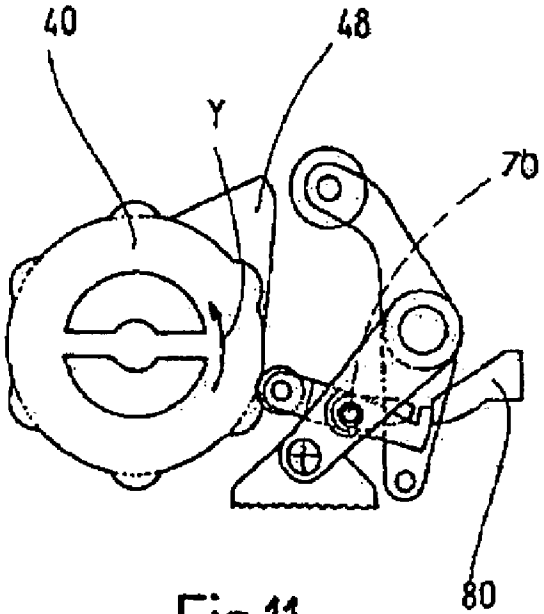

In the region of the lower third of the actuating lever 64, as viewed in FIG. 2, behind that lever 64, the lever 56 is coupled by a third axis 70 of rotation. An energy storage device in the form of a tension spring 72 biases the rear angle piece of the angle lever 56 to pivot counterclockwise around the third axis of rotation 70. Another energy storage device in the form of a compression spring 74 presses or biases the upper end of the lever 58 counterclockwise. This compression spring 74 is shown only as a functional element in FIG. 2, and is otherwise implemented as shown in FIG. 9 by a leg spring 76 for practical execution. The tension and compression springs can also be replaced by compression and tension springs, respectively, which, however, attach analogously elsewhere with their required force action. The angle lever 56 on its end opposite the curve roller 50 has a contact flank 78 in contact in the operating position shown in FIG. 2 with a catch support 80 which in the region of potential sliding off of the contact flank 78 is provided with a convex guideway 82. This catch support 80 with the formation of an abutment for the part of the lever drive is permanently connected to the housing 22 of the tensioning apparatus and is part of it.

The drive unit 10 preferably has a pneumatic motor, but could also have an electric motor or the like. The pneumatic motor has a rod on its one free face side ending in a drive pinion 84. Drive pinion 84 meshes with a continuous worm drive 86 which drives the winding shaft 50 of the band winding unit 12, counterclockwise (arrow Y) or in the opposite direction Z (see FIG. 7) depending on the direction of drive rotation of the pneumatic motor. The housing parts of the pneumatic motor are seated outside on the tensioning housing 22. The rotatable parts of the pneumatic motor, in particular in the form of the drive pinion 84, are guided within the housing 22.

The control cams 42 (a total of six) of the first control part 40 are arranged at discrete distances from one another extending along the closed curve path extending concentrically to the winding shaft 50. In this first embodiment, the control cams 42 are movable around a pivoting axis 88 against the action of another energy storage device in the form of compression springs 90. A different number of control cams 42 is possible. In this respect, the pivoting control cams 42 are held in at least the direction of rotation Y of the winding shaft 50 in the trigger position for parts of the lever drive in the form of the curve roller 60 of the angle lever 56. The second control part 46, as already described, has a control cam 48 forming on the outer peripheral side an involute path with control flanks 92, 94 tapering conically to its free end. Control flank 92 forms an abutment surface for parts of the lever drive in the form of a curve roller 60 for the upper angle lever 58.

The embodiment as depicted in FIG. 2 is shown without the cutting means. The FIG. 2 arrangement is sufficient to bring about an attachment process for a band 18. To complement the version shown in FIG. 2, a complete attachment cycle for the band 18 is described below using FIGS. 3 to 8 with inclusion of the cutting means or cutter 20. The band is only partially shown in the figures and only with its relevant regions.

Figure 3:
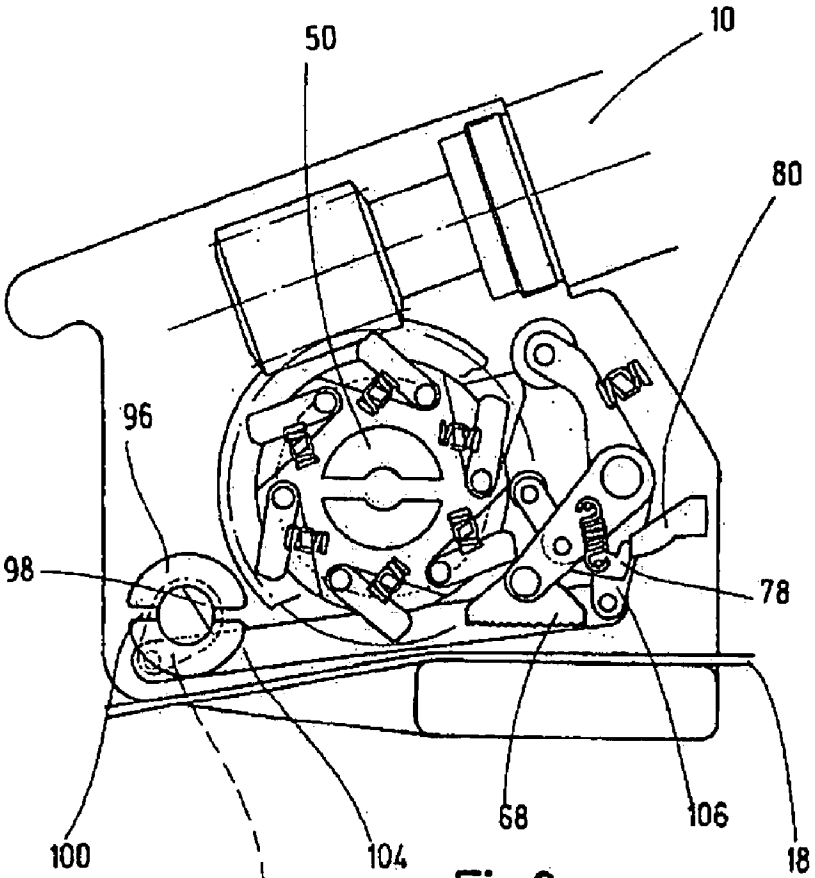

The cutting means shown in FIG. 3 et seq. can be pivoted, and is made comparably to the winding shaft 50 as a hollow sleeve 96 which in the expanded inner peripheral region has a cutting blade 98 projecting in the manner of a fin. Blade 98 has a free cutting edge projecting in the direction of the continuous longitudinal slot 100, and is connected as a pivoting cutting means 20 to a triangle lever 102 (cf. FIG. 3) triggered by a rod drive 104 via the lever drive. The lever drive acts pivotally on the longitudinal rod of the rod drive 104 by a lever piece 106. The rod drive 104, on its opposite free end, is articulated to the end of the triangle lever 102.

As FIG. 3 et seq. show, the hollow sleeve 96 remains in its position. The cutting blade 98 is pivoted counterclockwise via the rod drive 104 and the lever drive with the lever piece 106 out of its cutting position shown in FIG. 3 into a neutral position shown in FIG. 5 within the hollow sleeve 96. Blade 98 can then be rotated clockwise in turn into the cutting position shown in FIG. 8.

According to the initial or base position as shown in FIG. 3, the cutting blade 48 is held in the cutting position, and the locking means 68 is held in the opened position, i.e., the base plate or clamping plate is raised, as shown, toward the top over the lever drive. The drive device 10 is not actuated. The band 18 (not shown) is wrapped around the packed article or packaging article, and is inserted into the attachment clasp in the form of the eye 34 as shown in FIG. 2. The band 18 is placed on the guide surface 26 of the housing 22 by the band 18 being pulled through between the locking means 68 and the guide surface 26. The upper free end of the band is not yet inserted into the tensioning apparatus.

Figure 4:
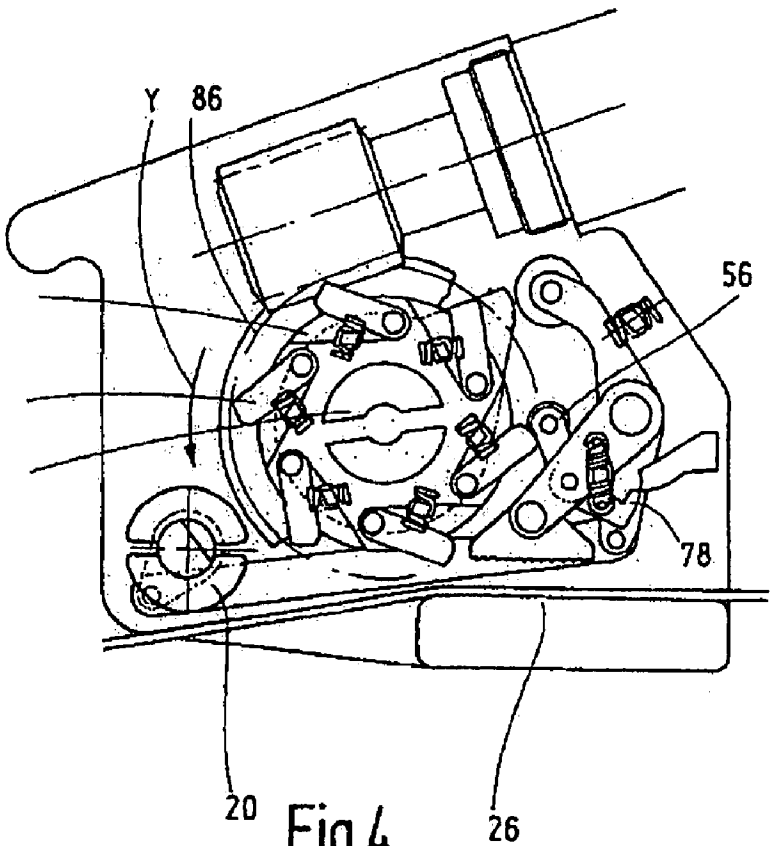
FIGS. 3 to 8 are side elevational views of the tensioning apparatus of FIG. 1 in different operating positions.
Figure 5:
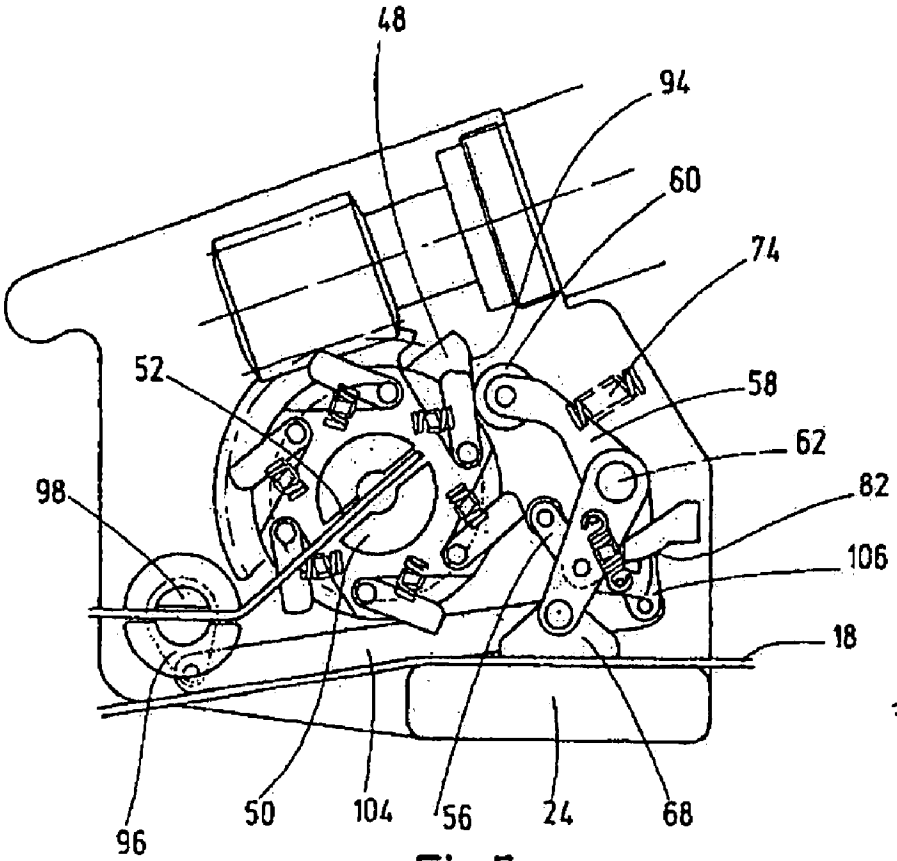

As shown in FIGS. 4 and 5, the drive unit 10 is then turned on for producing rotation counterclockwise in direction Y. As a result of the worm drive in the form of a continuous worm, the clockwise direction of rotation results in the winding shaft 50 also being rotationally entrained counterclockwise. The control cams 42 coupled to the disk-shaped first control part 40 actuate the angle lever 56 by its projecting guide roller 60. This angle lever 56 is then moved clockwise away from the projecting end of the engaged control cam 42 by pivoting around the pivoting axis 70 so that in this respect the other angle lever 58 is released and can turn counterclockwise around the pivoting axis 62. This rotation takes place until the clamping plate of the locking means 68 as shown in FIG. 5 under the spring force of the energy storage device 74 is moved downwardly and clamps the band 18 in this way.

Then "overcentering" would take place between the movable lever parts via the lever drive made as a toggle joint lever drive. This "overcentering" accordingly raises the clamping force for the locking means 68. For this position, the angle lever 58, as shown in FIG. 5, with its guide roller 60 is in contact with the flank 94 of the control cam 48. Until clamping of the band 18 takes place within the locking means 68, the triggering process is also used to guide the free end of the band through the longitudinal slot 100 within the hollow sleeve 96 and to allow the end of the band to engage the longitudinal slot 52 of the winding shaft 50 for a winding process. To enable this process, by pivoting the rod drive 104 back by the lever piece 106 coupled to the angle lever 58, the cutting blade 98 is moved out of its cutting position, shown in FIGS. 3 and 4, into the upper inactive position as shown in FIG. 5. The sharp blade edge extends parallel to the longitudinal slot 100 of the cutting means 20. This entrainment of the lever piece 106 counterclockwise around the pivoting axis 62 is induced by the feed motion of the lever 58 under the action of the compression spring 74.

As follows from FIGS. 3 to 5, the contact flank 78 of the angle lever 56 is first in supportive contact with the free face side of the catch support 80. As a result of the described lever motion, first the contact flank 78 is guided along the concave face-side path of the catch support 80 until it catches underneath. At this point, sliding along the lower convex guide path 82 of the catch support 80 is induced, a movement supported by the tension spring arrangement 72. The tension spring 72 with its two free ends is coupled on the one hand to the actuating lever 64 and on the other hand to the angle lever 56 in the region of the acting flank 78. As soon as the position as shown in FIG. 5 has been assumed, the drive unit 10 is stopped. The drive unit 10 in the form of the pneumatic motor is turned on and off by actuating knobs (not shown) permitting one-hand operation for the entire tensioning apparatus. For each direction of rotation of the drive unit 10, preferably an actuating knob indicates the direction.

Figure 6:
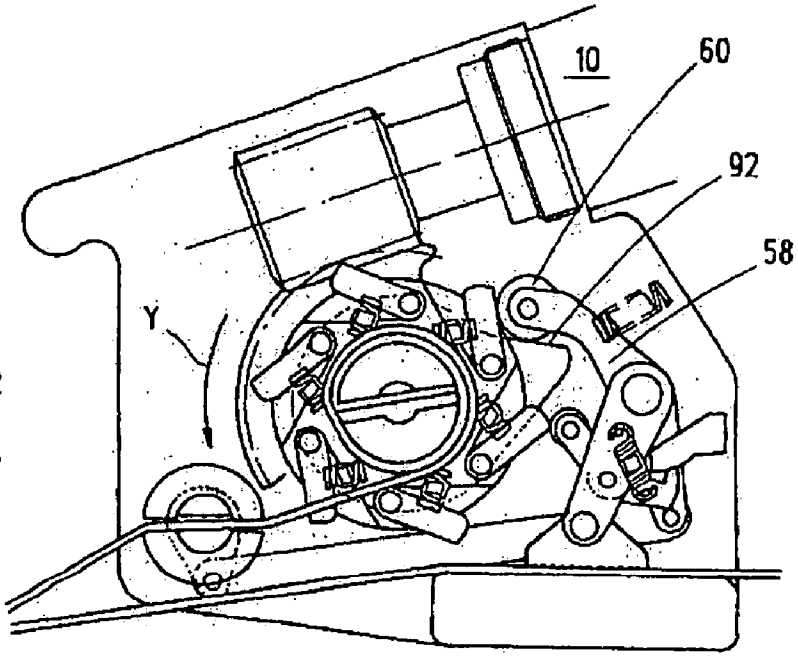

As shown in FIG. 6, the drive unit 10 has again been turned on and the winding shaft 50 according to the direction of rotation Y has brought about several winding processes for the end 36 of the band. The second control part 46 with the control cam 48 is then entrained via frictional engagement until the flank 92 used as the abutment surface makes contact with the guide roller 60 of the other lever 59, extending underneath it. At this point, the band can be further wound by actuating the winding shaft 50, and is tensioned until a set tensioning force is reached and dictated by the pneumatic motor in terms of its possible pressure balance. Viewed in the direction of FIG. 2, the eye or thimble 34 is pulled in the direction of arrow X toward the tension housing 22 of the apparatus. The band then straps the packaged article positively and nonpositively. If excess winding of the band material on the winding shaft 50 were to occur unexpectedly beforehand, the drive 10 could be shut off by hand in this case.

Figure 8:
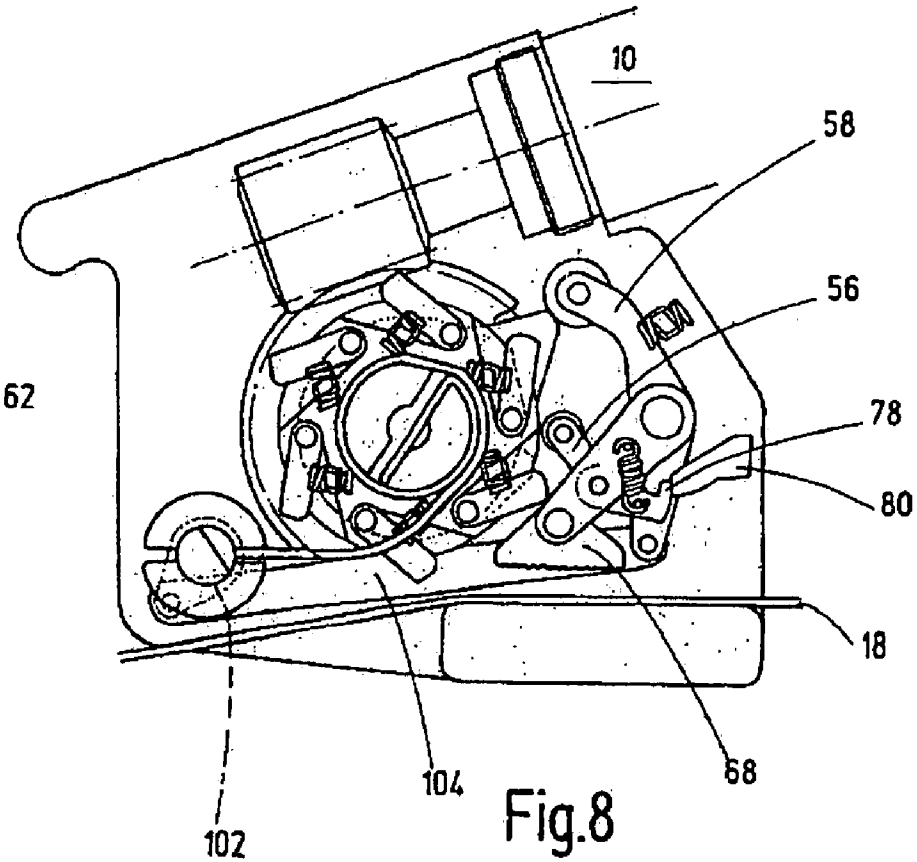
Figure 7:
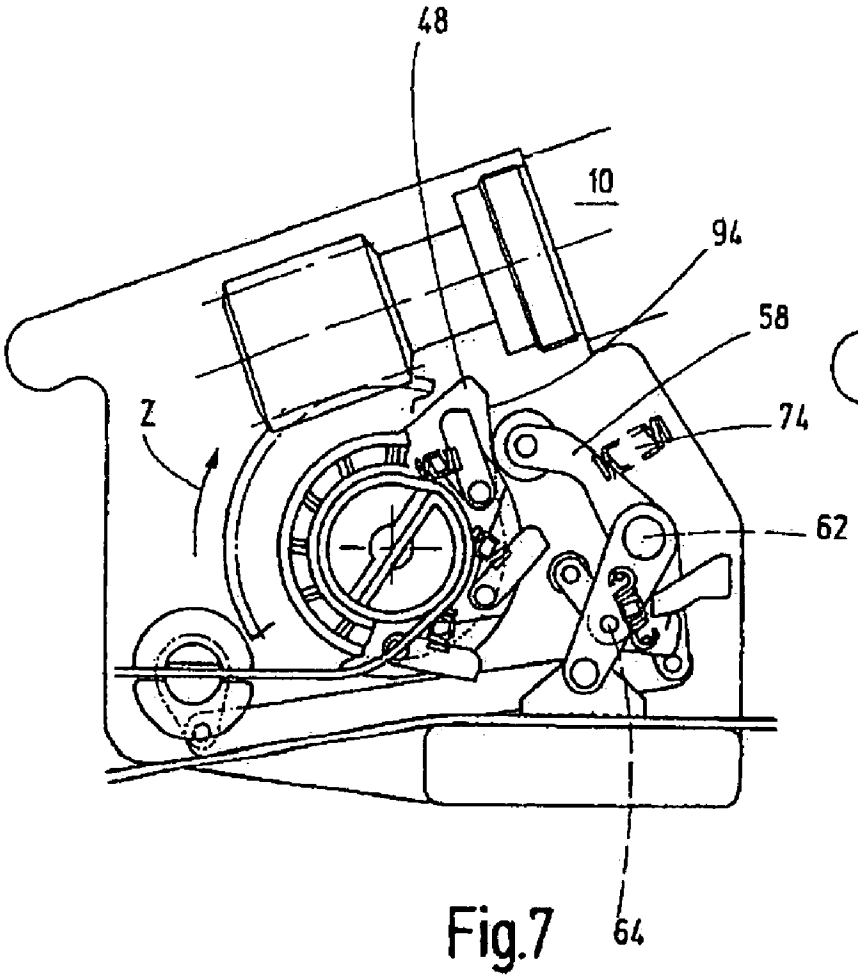

In the continuation of the process as shown in FIGS. 7 and 8, the drive unit 10 is then turned on and there is rotation in the Z direction as shown in FIG. 7 for the winding shaft 50. Therefore, it turns clockwise. In the opposing motion, the tension of the band 18 at the clamping site, that is, in the region of the locking means 68, is relieved. At the same time the control cam 48 of the second control part 46 is entrained away from the stop, clockwise Z via the freewheeling or freewheeling means 54. After approximately ¾ of a revolution the flank 94 of the control cam 48 comes into contact with the guide roller 60 of the lever 58 and the actuating lever 58 is moved clockwise against the spring force of the energy and spring storage device in the form of the compression or leg spring 74 around the pivoting axis 62. Due to this motion of the lever 56, as shown in FIG. 8, the clamping plate of the locking means 68 is raised, and then releases the band 18. At the uppermost curve point, the lever 58 with its contact flank 78 then passes the edge of the stationary catch support 80, and is then turned counterclockwise around the pivoting axis 64 by spring force and is supported in turn on the free face side of the catch support 80. Accordingly, this actuating lever 56 is fixed in this position when the clamp is opened.

With the opening of band clamping, by the rod drive 104 the cutting blade 98 is pivoted clockwise via the triangle lever 102 and is moved into its cutting position shown in FIG. 8. In this cutting position shown in FIG. 8, the band 18 is severed on the end side at that location. The spring-loaded control cams 42 sliding past the curve roller 60 of the angle lever 56 are folded or pivoted away against the spring force, and thus, do not hinder the release process for the band. The drive unit 10 can then be turned off. With respect to the severed band 18 with the band clamping opened, the tension apparatus can be removed. The band residue which remains on the winding shaft 50 as shown in FIG. 8 can then be easily removed by hand. The band tensioning apparatus is then available for a repeated tensioning process according to its initial position as shown in FIG. 3.

In the second embodiment shown in FIGS. 10 to 13, the disk-shaped control part 40 interacting with the winding shaft 50 is equipped with stationary control cams 42*a* instead of the spring-loaded, movable control cams 42. To achieve the same action as described above, in addition to the angle lever 56, another angle lever 108 is provided having the same pivoting axis 70 as the lever 56. The free end of angle lever 108 overlaps the other angle 56 in the region of the contact flank 78 on the end side with an overlap piece 110 (cf. FIG. 12). In this contact position, the angle lever 108 is held via another tension spring 112. The overlap piece 110 ensures that the angle lever 56 with its contact surface 78 can extend underneath, engaging the stationary catch support 80, according to the foregoing description (cf. FIG. 13).

Figure 14:
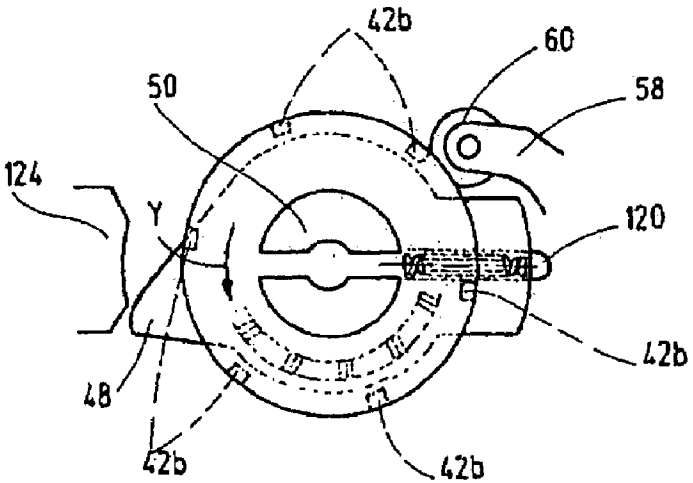
FIGS. 14 and 16 are side elevational views and FIGS. 15 and 17 are plan views of a tensioning apparatus according to a third embodiment of the present invention, modified relative to the control device.
Figure 16:
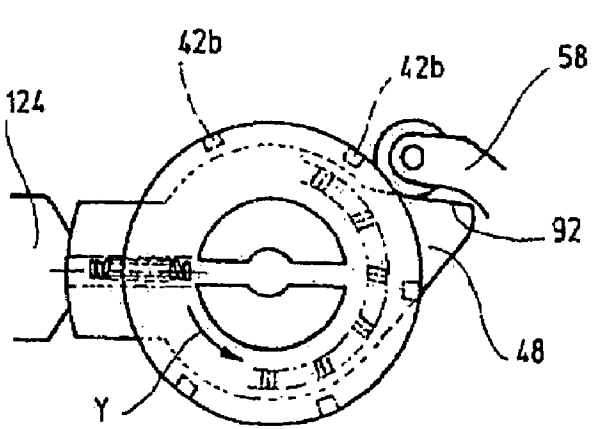
Figure 15:
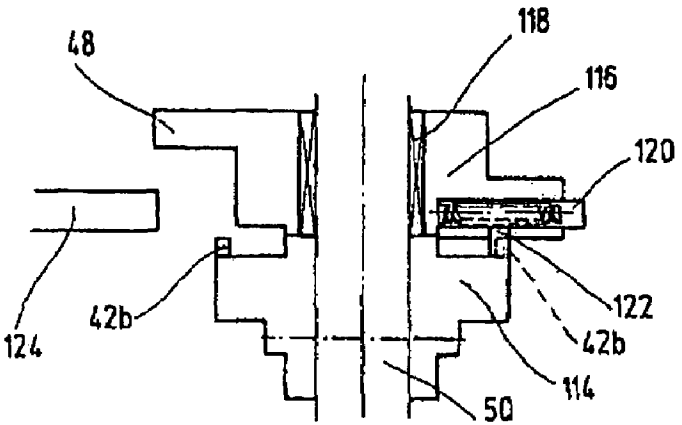
Figure 17:
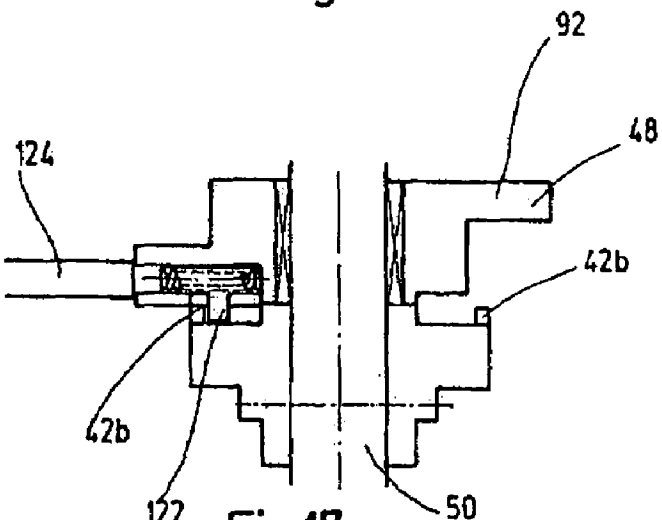

In the third embodiment shown in FIGS. 14 to 17, the control disk as the first control part 40 connected securely to the latter, viewed in the direction of FIGS. 14 and 16, has control cams 42*b* projecting to the rear. If, as already described, the drive unit 10 is turned on, the direction of rotation Y is to result and the winding shaft 50 turns counterclockwise. The control disk is the driver disk 114 permanently connected to the winding shaft 50. An actuating disk 116, pivotally guided on the winding shaft by a conventional bearing site 118 provided with freewheeling, has a spring-loaded actuating pin 120. Viewed in the direction of FIGS. 14 and 15, actuating pin 120 keeps a projecting actuating journal 122 in contact with the projecting, underlying stationary control cam 42*b*. When the actuating disk 116 continues to be pivoted in the direction of rotation Y, the actuating pin 120 comes into contact with a control housing part 124, and, as shown in FIGS. 16 and 17, is pressed to the inside against the actuating force of the spring arrangement of the actuating pin 120. The actuating journal 122 guided to the inside disengages from the pertinent control cam 42*b*. This action leads to decoupling of the control disk 114 as a control part 14. The winding shaft 50 can then continue to turn counterclockwise Y. In the process, the control flank 92 in turn comes into contact with the lever 58, extending underneath it. The operation description above in this respect applies to the continuing sequence of motions and also to the illustrated modified embodiment.

While various embodiments have been chosen to illustrate the invention, it will be understood by those skilled in the art that various changes and modifications can be made therein without departing from the scope of the invention as defined in the appended claims.

What is claimed is:

1. An apparatus for tensioning a band, comprising:

a band winding unit having a control and a winding shaft, said control having a first control part with first control cams thereon and having a second control part with a second control cam thereon, said first and second control parts being coupled to said winding shaft for rotation therewith in at least one direction, at least said second control part having a free wheel device allowing rotation thereof by said winding shaft in at least one direction and allowing said second control part to maintain a set position independent of rotation of said winding shaft;

a drive unit coupled to said band winding unit and selectively driving said band winding unit alternatively in opposite rotational directions;

an actuator triggered by said control; and a releasable band lock, coupled to said band winding unit, to releasably secure a band in definable positions.

2. An apparatus according to claim 1 wherein said actuator comprises a multiple part lever drive having a first lever triggered by said first control part and having a second lever triggered by said second control part; and said lock is on a free end of said lever drive.

3. An apparatus according to claim 2 wherein said first control cams extend from said first control part at points at discrete distances from one another and along a closed curved path concentric to said winding shaft.

4. An apparatus according to claim 3 wherein said first control part has a control disk with said first control cams being at least partially rigid components thereof.

5. An apparatus according to claim 3 wherein said first control cams are pivotally mounted on said first control part and are biased by energy storage devices in at least one pivotal direction toward positions for triggering said actuator.

6. An apparatus according to claim 2 wherein said second control cam has first and second control flanks tapering conically to a free end of said second control cam, said first control flank forming an abutment surface for parts of said actuator.

7. An apparatus according to claim 2 wherein said band winding unit, said drive unit, said actuator and said band lock are integrated in a housing, said housing having a catch support adjacent said actuator and forming an abutment for an actuator part of said actuator when said actuator part acts on said catch support.

8. An apparatus according to claim 2 wherein
parts of said actuator are held in active contact positions with said control by energy storage devices.

9. An apparatus according to claim 2 wherein
a rotatable band cutter coupled to said band winding unit and guided for movement in a slot guide has at least one cutting blade to cut a band.

10. An apparatus according to claim 9 wherein
a rod drive is coupled to and drives said rotatable cutter, and is coupled to and driven by said actuator.

11. An apparatus according to claim 2 wherein
said drive unit comprises a pneumatic motor rotatable in two opposite rotational directions and interactively coupled to said band winding unit by a worm drive.

12. An apparatus according to claim 1 wherein
said first control cams extend from said first control part at points at discrete distances from one another and along a closed curved path concentric to said winding shaft.

13. An apparatus according to claim 12 wherein
said first control part has a control disk with said first control cams being at least partially rigid components thereof.

14. An apparatus according to claim 12 wherein
said first control cams are pivotally mounted on said first control part and are biased by energy storage devices in at least one pivotal direction toward positions for triggering said actuator.

15. An apparatus according to claim 1 wherein
said second control cam has first and second control flanks tapering conically to a free end of said second control cam, said first control flank forming an abutment surface for parts of said actuator.

16. An apparatus according to claim 1 wherein
said band winding unit, said drive unit, said actuator and said band lock are integrated in a housing, said housing having a catch support adjacent said actuator and forming an abutment for an actuator part of said actuator when said actuator part acts on said catch support.

17. An apparatus according to claim 1 wherein
parts of said actuator are held in active contact positions with said control by energy storage devices.

18. An apparatus according to claim 1 wherein
a rotatable band cutter coupled to said band winding unit and guided for movement in a slot guide has at least one cutting blade to cut a band.

19. An apparatus according to claim 18 wherein
a rod drive is coupled to and drives said rotatable cutter, and is coupled to and driven by said actuator.

20. An apparatus according to claim 1 wherein
said drive unit comprises a pneumatic motor rotatable in two opposite rotational directions and interactively coupled to said band winding unit by a worm drive.

* * * * *